US009996027B1

(12) United States Patent
Chuang et al.

(10) Patent No.: US 9,996,027 B1
(45) Date of Patent: Jun. 12, 2018

(54) TONER CARTRIDGE

(71) Applicant: General Plastic Industrial Co. Ltd., Taichung (TW)

(72) Inventors: Chin-His Chuang, Taichung (TW); Chi-Chin Huang, Taichung (TW)

(73) Assignee: GENERAL PLASTIC INDUSTRIAL CO., LTD, Taichung (TW)

( * ) Notice: Subject to any disclaimer, the term of this patent is extended or adjusted under 35 U.S.C. 154(b) by 0 days. days.

(21) Appl. No.: 15/708,513

(22) Filed: Sep. 19, 2017

(30) Foreign Application Priority Data

Aug. 15, 2017 (TW) ..... 106127630 A

(51) Int. Cl.
*G03G 15/08* (2006.01)

(52) U.S. Cl.
CPC ..... *G03G 15/087* (2013.01); *G03G 15/0898* (2013.01)

(58) Field of Classification Search
CPC ..... G03G 15/0834; G03G 15/087; G03G 15/0881; G03G 15/0841; G03G 2215/0687; G03G 2215/088
See application file for complete search history.

(56) References Cited

U.S. PATENT DOCUMENTS

2008/0013983 A1* 1/2008 Mihara ..... G03G 15/0872 399/106
2010/0226690 A1* 9/2010 Kadota ..... G03G 15/0867 399/262

FOREIGN PATENT DOCUMENTS

JP 2009204631 A * 9/2009

* cited by examiner

*Primary Examiner* — Victor Verbitsky
(74) *Attorney, Agent, or Firm* — Muncy, Geissler, Olds & Lowe, P.C.

(57) ABSTRACT

A toner cartridge includes a barrel having an opening, a transmission cap rotatably disposed to the barrel and blocking the opening, a sealing tape, and a toner conveying shaft rotatably disposed inside the barrel. The transmission cap has an outlet and an inner drive portion. The sealing tape has a first end sealing the outlet, and a second end fixedly mounted to the barrel. The toner conveying shaft has a driven portion. During a rotational period of the transmission cap, the first end of the sealing tape detaches from the outlet first, and then the inner drive portion abuts against the driven portion. When the transmission cap continuously rotates, the toner conveying shaft is driven by the transmission cap to rotate. As such, the transmission cap can drive the toner conveying shaft to synchronously rotate after the transmission cap brings the sealing tape to detach from the outlet.

9 Claims, 13 Drawing Sheets

TONER CARTRIDGE

BACKGROUND OF THE INVENTION

1. Field of the Invention

The present invention relates generally to a device used in an image-forming apparatus and more particularly, to a toner cartridge used in an image-forming apparatus.

2. Description of the Related Art

It is known that the methods of discharging toner used in commercially available toner cartridges can be roughly classified into two ways. The first way is to provide a recessed threaded portion on the surface of a toner barrel of a toner cartridge, such that when the toner barrel rotates, the toner inside the barrel will be gradually marched by the rotatory threaded portion toward an opening of the barrel and then discharged out. The second way is to provide a toner conveying device that is rotatably disposed inside the toner barrel, such that when the toner conveying device rotates, the toner inside the barrel is stirred and brought toward the opening of the barrel.

In the above-mentioned second way, the toner cartridge is composed of a transmission cap rotatably disposed to the opening of the barrel for driving the toner conveying device to rotate. As soon as the toner conveying device rotates, the toner will first move in the barrel toward the opening, and then pass through an outlet of the transmission cap, and finally be discharged out of the toner cartridge via a toner exit of the barrel. For a new, unused toner cartridge of this type, the toner cartridge is provided with a sealing tape having a first end fixedly mounted to the barrel, and a second end adhering and blocking over the outlet of the transmission cap. After the new toner cartridge is installed in an image-forming apparatus and starts to rotate, the first end of the sealing tape stays stationary and the second end of the sealing type will move along with the rotary transmission cap until the send end, which is stretched by the stationary first end, detaches from the outlet of the transmission cap, thereby enabling the toner inside the barrel to freely pass through the outlet.

In the above-mentioned design, the transmission cap not only has to drive the toner conveying device to synchronously rotate but also needs to peel off the second end of the dealing tape from its outlet. Since the transmission cap used in the conventional image-forming apparatus usually provides a limit torque that is just sufficient to drive the toner conveying device to rotate, the transmission may get jammed if the torque is not great enough to simultaneously overcome the adhesion force of the sealing tape.

SUMMARY OF THE INVENTION

The present invention has been accomplished in view of the above-noted circumstances. It is an objective of the present invention to provide a toner cartridge having a sealing tape, which is attached over an outlet of a transmission cap. When the transmission cap starts to rotate, the sealing tape will be peeled off first, and thereafter the transmission cap drives a toner conveying device to synchronously rotate.

To attain the above objective, the present invention provides a toner cartridge comprising a barrel, a transmission cap, a sealing tape and a toner conveying shaft. The barrel has an end with an opening, and a lateral periphery with a toner exit. The transmission cap is rotatably disposed to the end of the barrel and blocks the opening of the barrel. The transmission cap has an outer side provided with at least one outer drive portion, a lateral periphery provided with an outlet, and an inner side provided with at least one inner drive portion. The sealing tape has a first end that seals the outlet of the transmission cap, and a second end fixedly mounted to the barrel. The toner conveying shaft is rotatably disposed inside the barrel and has an end provided with at least one driven portion. When the transmission cap rotates from an initial position to a first position, the first end of the sealing tape detaches from the outlet of the transmission cap. When the transmission cap rotates from the first position to a second position, the inner drive portion abuts against the driven portion of the toner conveying shaft. When the transmission cap continuously rotates from the second position, the toner conveying shaft is rotated along with the transmission cap.

As such, the transmission cap will bring the sealing tape, which is adhered over the outlet of the transmission cap, to be peeled off first, and thereafter drive the toner conveying shaft to synchronously rotate.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
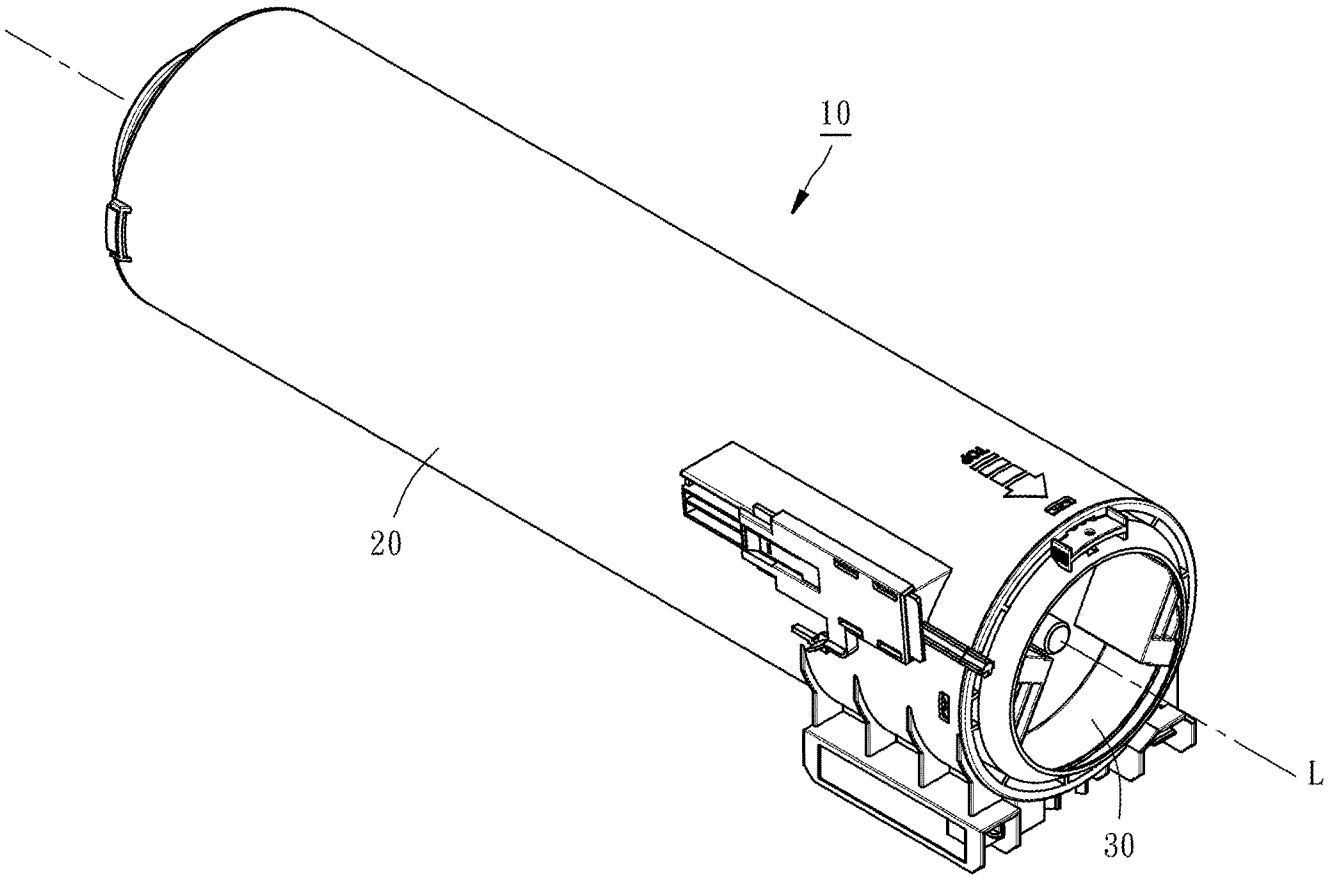
FIG. 1 is a perspective view of a toner cartridge according to a preferred embodiment of the present invention.
Figure 2:
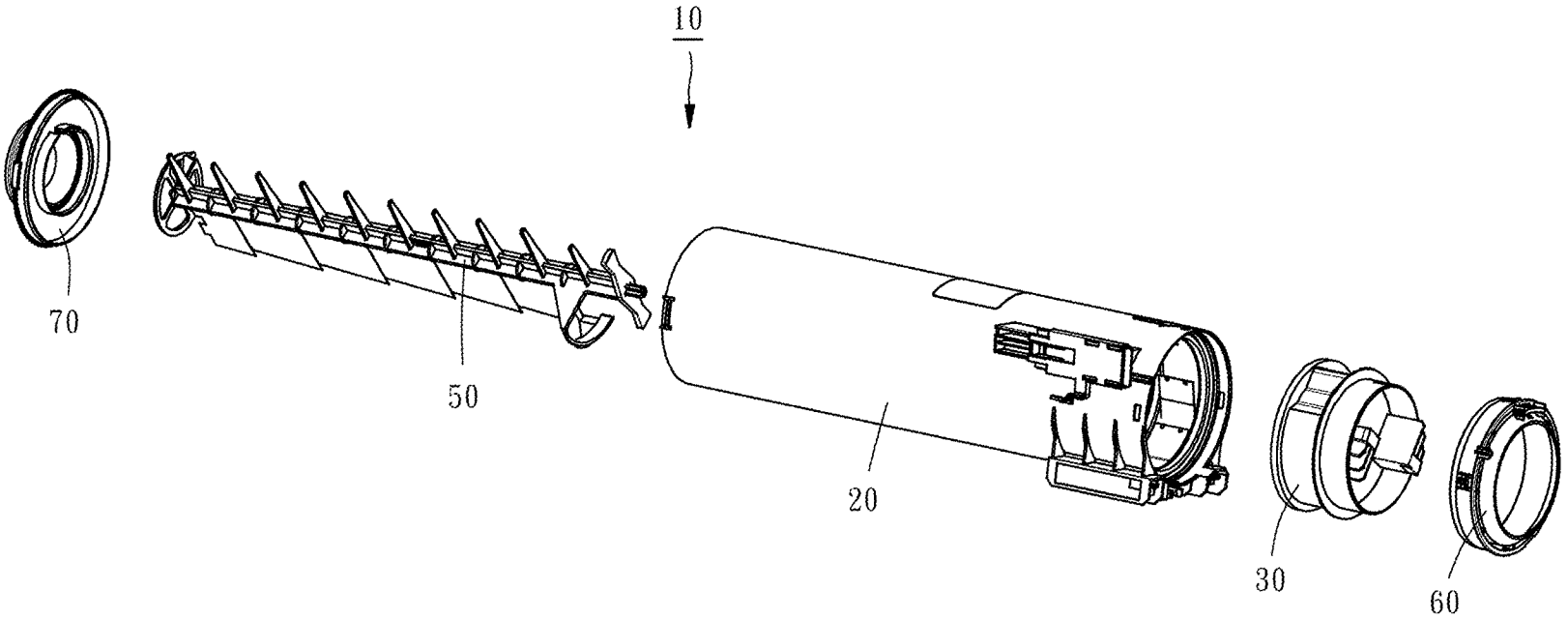
FIG. 2 is an exploded view of the toner cartridge of FIG. 1.

FIGS. 1 and 2 show a toner cartridge 10 in accordance with a preferred embodiment of the present invention. The toner cartridge 10 is composed of a barrel 20, a transmission cap 30, a sealing tape (see FIG. 7), a toner conveying shaft 50, a head cover 60 and a tail cover 70. The toner cartridge 10 can define an imaginary center line L axially passing through a center of the toner cartridge 10.

Figure 3:
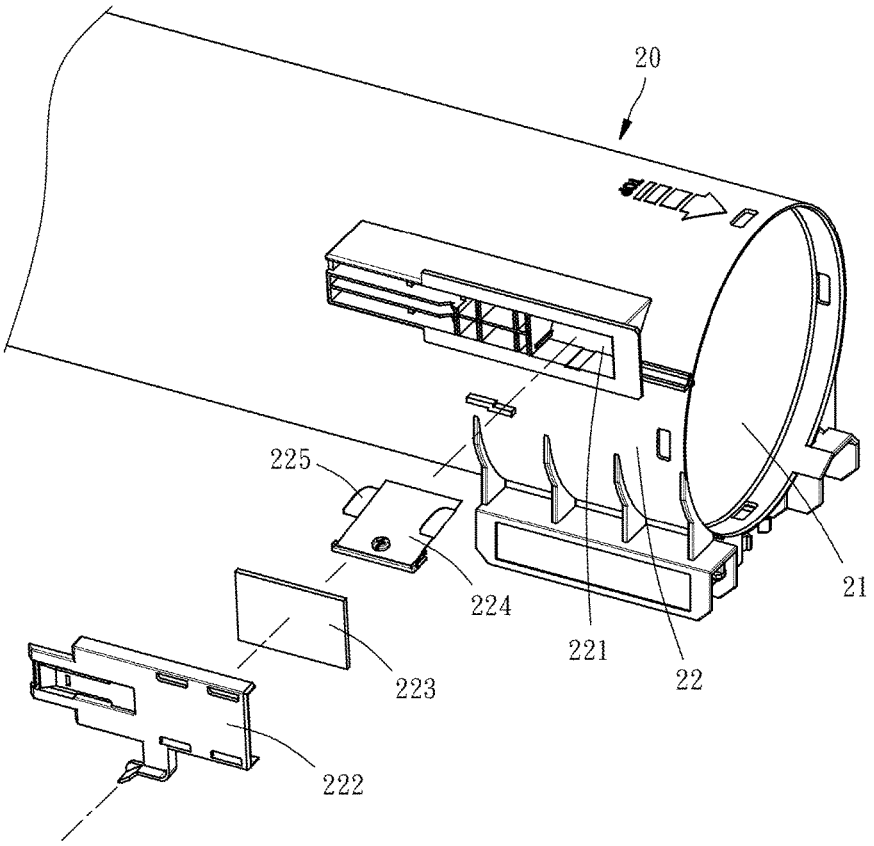
FIG. 3 is a partially exploded view of a barrel of the toner cartridge according to the preferred embodiment of the present invention.
Figure 4:
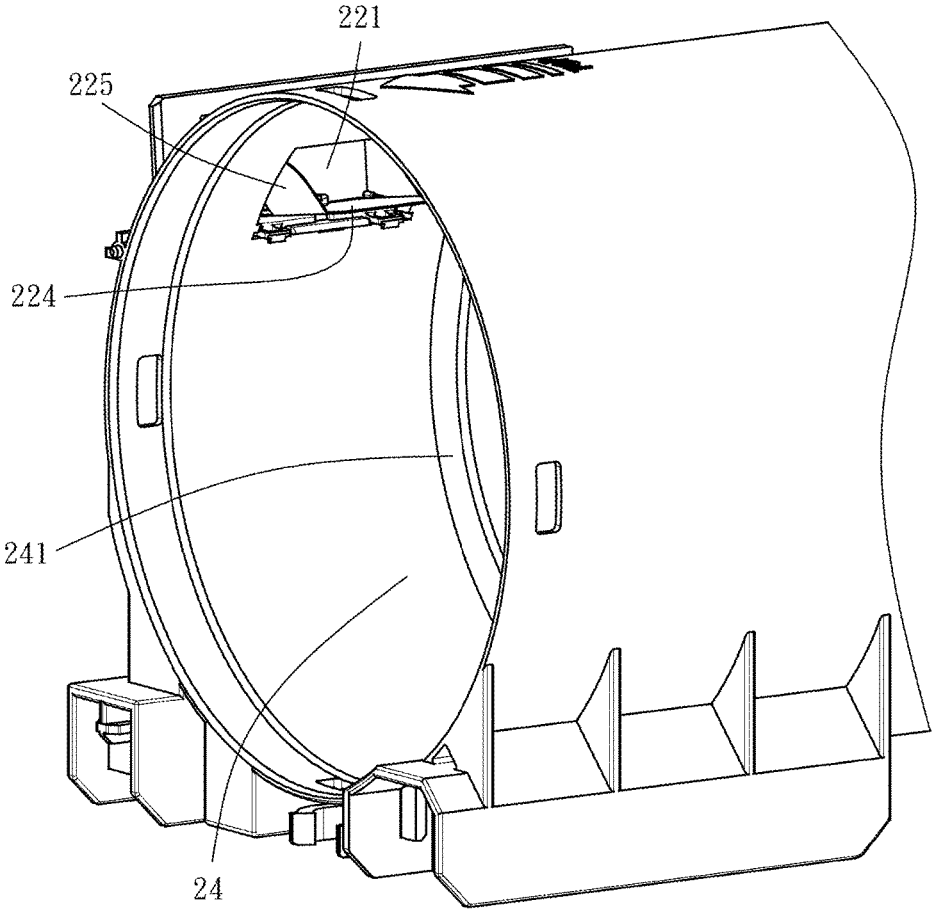
FIG. 4 is a partially perspective view of the barrel of the toner cartridge according to the preferred embodiment of the present invention.

The barrel 20 is loaded with toner therein. Referring to FIGS. 3 and 4, the barrel 20 is provided at an end thereof with an opening 21, and at a lateral periphery 22 thereof with a toner exit 221. A slider piece 222, on which a sealing member 223 is disposed, is slidably disposed over the toner exit 221 and slidably moveable between a closed position where the sealing member 223 blocks the toner exit 221, and an opened position where the sealing member 223 departs from the toner exit 221. A toner guiding member 224 is disposed at a bottom edge of the toner exit 221. The toner guiding member 224 is provided at each of two lateral sides thereof with a toner guiding sheet 225 for guiding and collecting toner. The barrel 20 is provided at an internal periphery 24 thereof with a limit ring 241.

Figure 5:
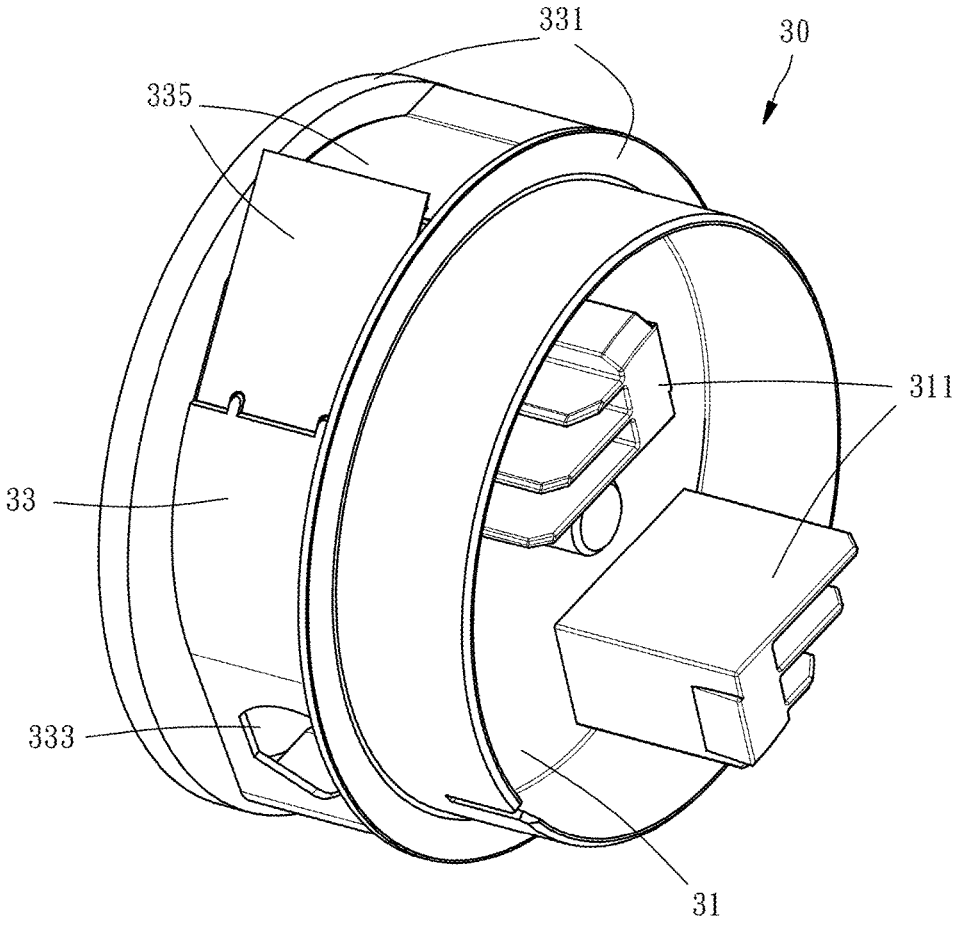
FIG. 5 is a perspective view of a transmission cap of the toner cartridge according to the preferred embodiment of the present invention.
Figure 6:
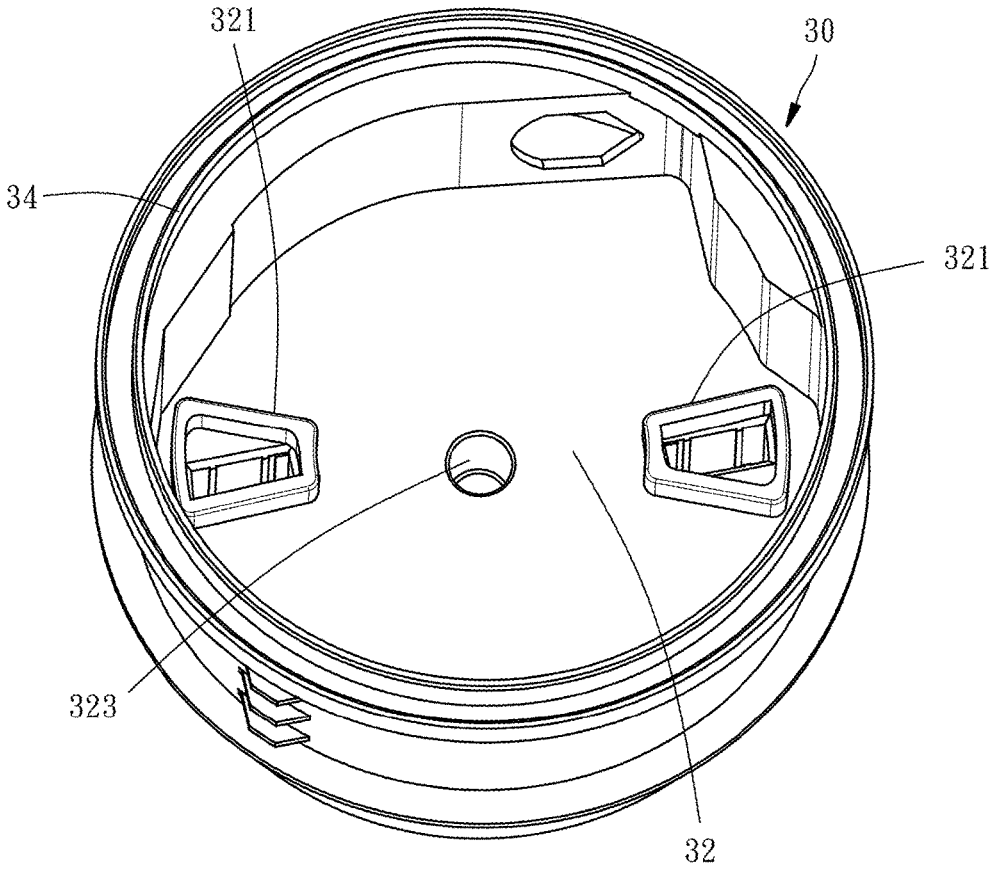
FIG. 6 is another perspective view of the transmission cap of the toner cartridge according to the preferred embodiment of the present invention.

Referring to FIGS. 5 and 6, the transmission cap 30 is rotatably disposed to an end of the barrel 20 and blocks the opening 21 of the barrel 20. An outer side 31 of the transmission cap 30 is provided with two outer drive portions 311, and an inner side 32 of the transmission cap 30 is provided with two inner drive portions 321 and an axle coupling portion 323. A lateral periphery 33 of the transmission cap 30 is provided with two protrusion rings 331, an outlet 333 between the two protrusion rings 331, and two resilient pieces 335 between the two protrusion rings 331. After the transmission cap 30 is assembled with the barrel 20, the toner exit 221 of the barrel 20 is located between the two protrusion rings 331, a distal end of the toner guiding member 224 extends into a space between the two protrusion rings 331, and an inner lateral edge 34 of the transmission cap 30 abuts against the limit ring 241 of the barrel 20, such that transmission cap 30 is restricted by the limit ring 24 and will not move toward an inside of the barrel 20.

Figure 7:
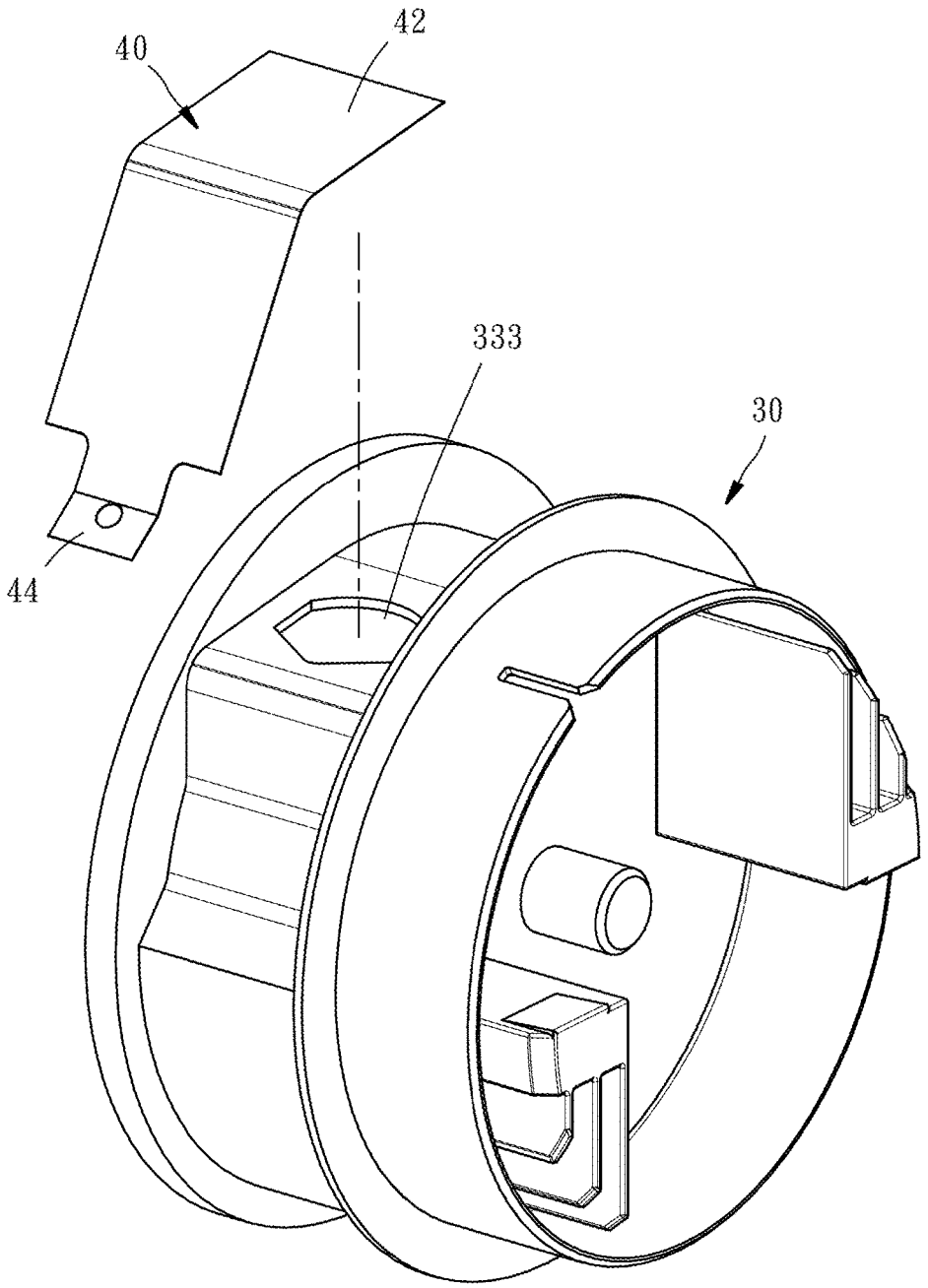
FIG. 7 is a schematically exploded view, showing a sealing tape and the transmission cap of the toner cartridge according to the preferred embodiment of the present invention.
Figure 8:
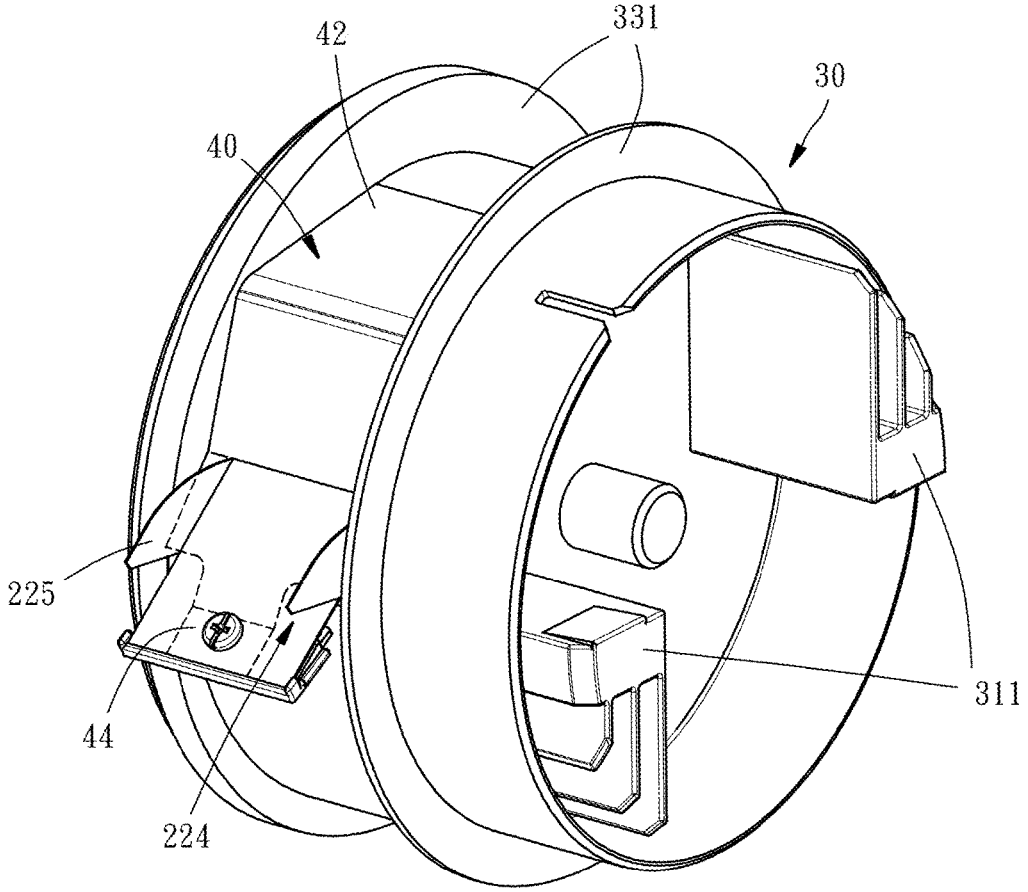
FIG. 8 is a perspective view, showing the sealing tape and the transmission cap are assembled with each other.

Referring to FIGS. 7 and 8, the sealing tape 40 has a first end 42 that seals the outlet 333 of the transmission cap 30, and a second end 44 fixedly mounted to a bottom edge of the toner exit 221 of the barrel 20. In this embodiment, the second end 44 of the sealing tape 40 is fixedly mounted below the toner guiding member 224 by a screw, and the first end 42 of the sealing tape 40 is adhered to the transmission cap 30 in such a way that the first end 42 blocks over the outlet 333 of the transmission cap 30.

Figure 9:
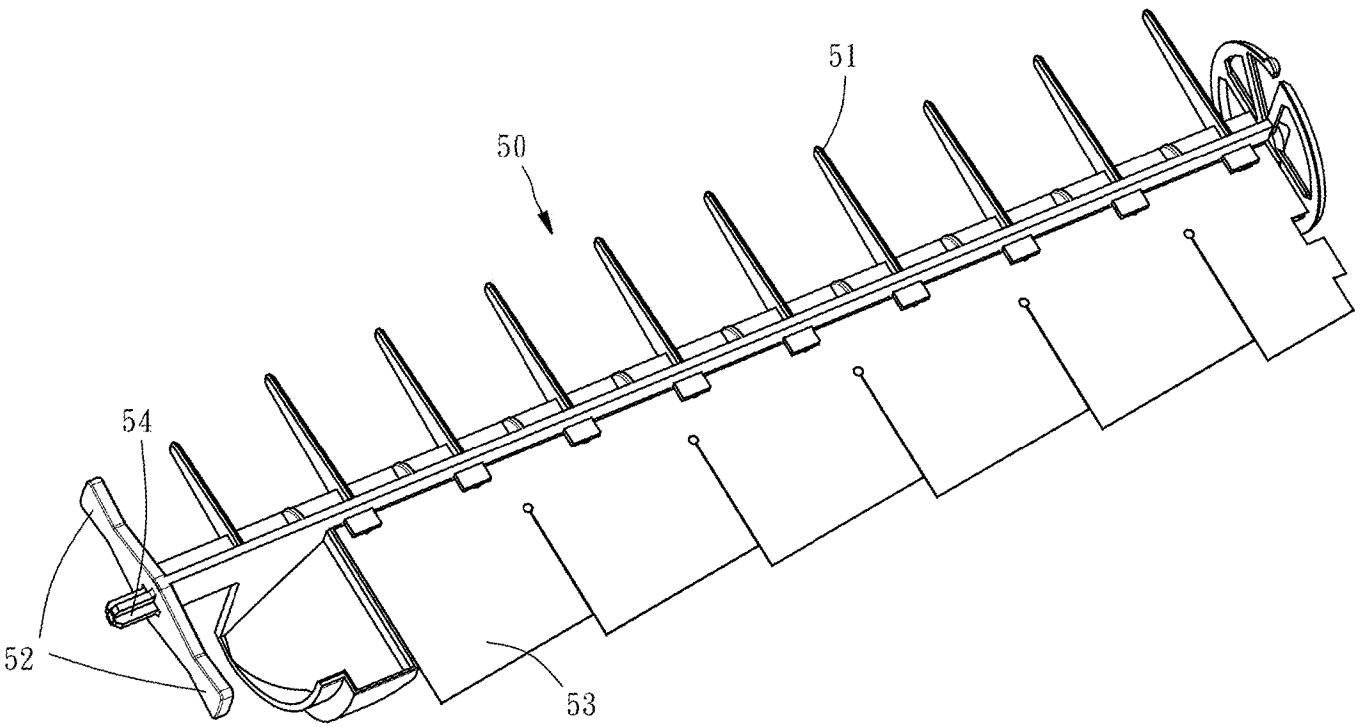
FIG. 9 is a perspective view of a toner conveying shaft of the toner cartridge according to the preferred embodiment of the present invention.

The toner conveying shaft 50 is rotatably disposed inside the barrel 20. As shown in FIG. 9, the toner conveying shaft 50 has an end provided with two radially extending driven portions 52. The shaft body of the toner conveying shaft 50 is provided with a plurality of stir rods 51 for stirring toner, and a conveying blade 53 for moving the toner inside the barrel 20 toward the opening 21. In this embodiment, the end of the toner conveying shaft 50 is provided with a protrusion axle 54 outwardly extending between the two driven portions 52. The protrusion axle 54 is inserted through the axle coupling portion 323 of the transmission cap 30, such that the toner conveying shaft 50 and the transmission cap 30 are arranged in a coaxial manner and the toner conveying shaft 50 is rotatable relative to the transmission cap 30. In other feasible embodiment, the toner conveying shaft 50 may include a plurality of conveying blades 53.

The head cover 60 is disposed at an end of the barrel 20 to limit and hold the transmission cap 30 in position so as to prevent the transmission cap 30 from escape from the barrel 20. The tail cover 70 is disposed at the other end of the barrel 20 and connected with the toner conveying shaft 50.

Figure 10:
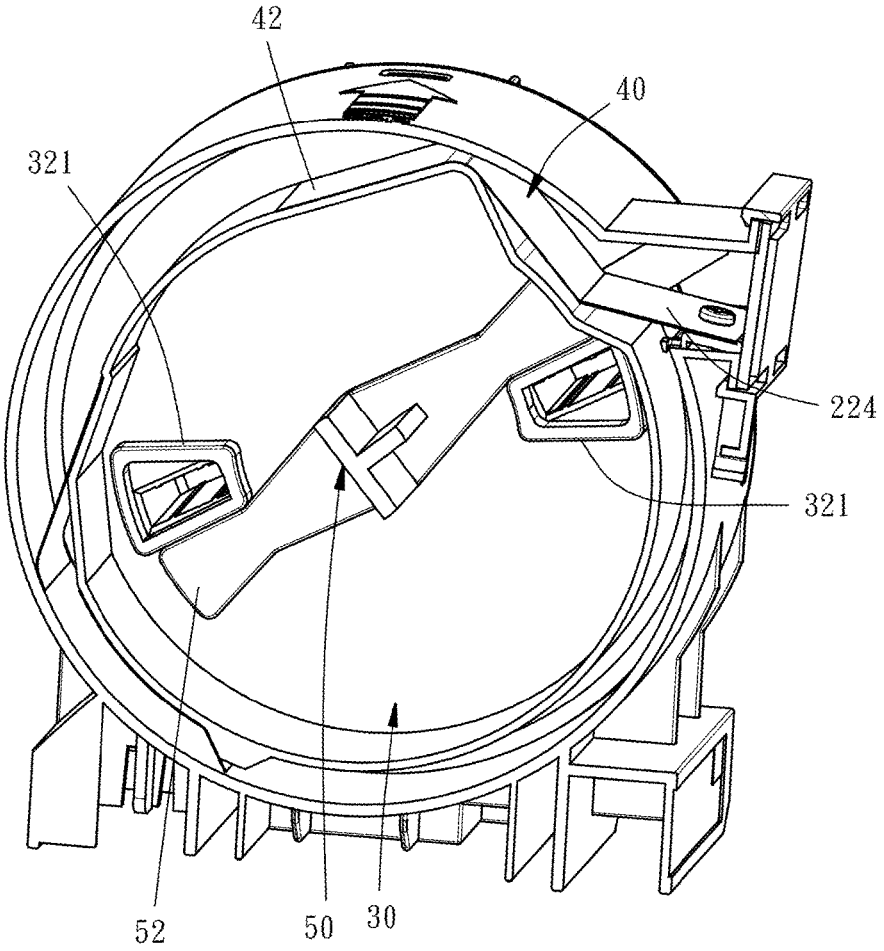
FIG. 10 is a schematic perspective view, showing the transmission cap stays at an initial position.
Figure 11:
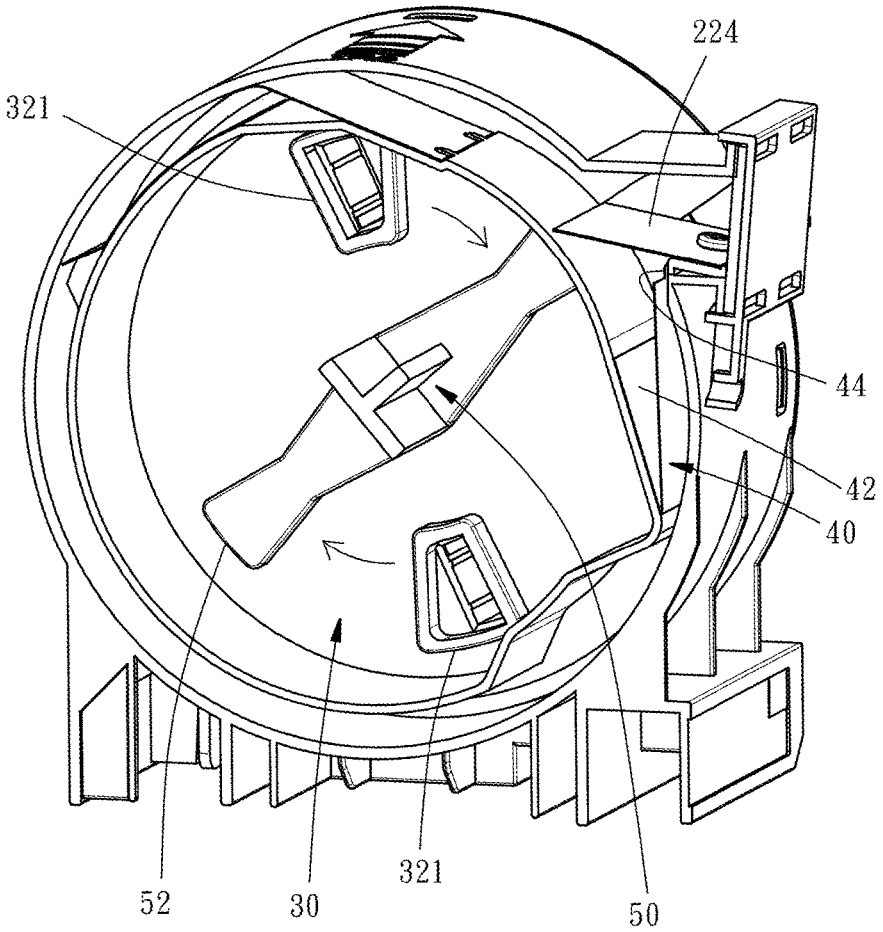
FIG. 11 is a schematic perspective view, showing the transmission cap rotates to a standby position.
Figure 12:
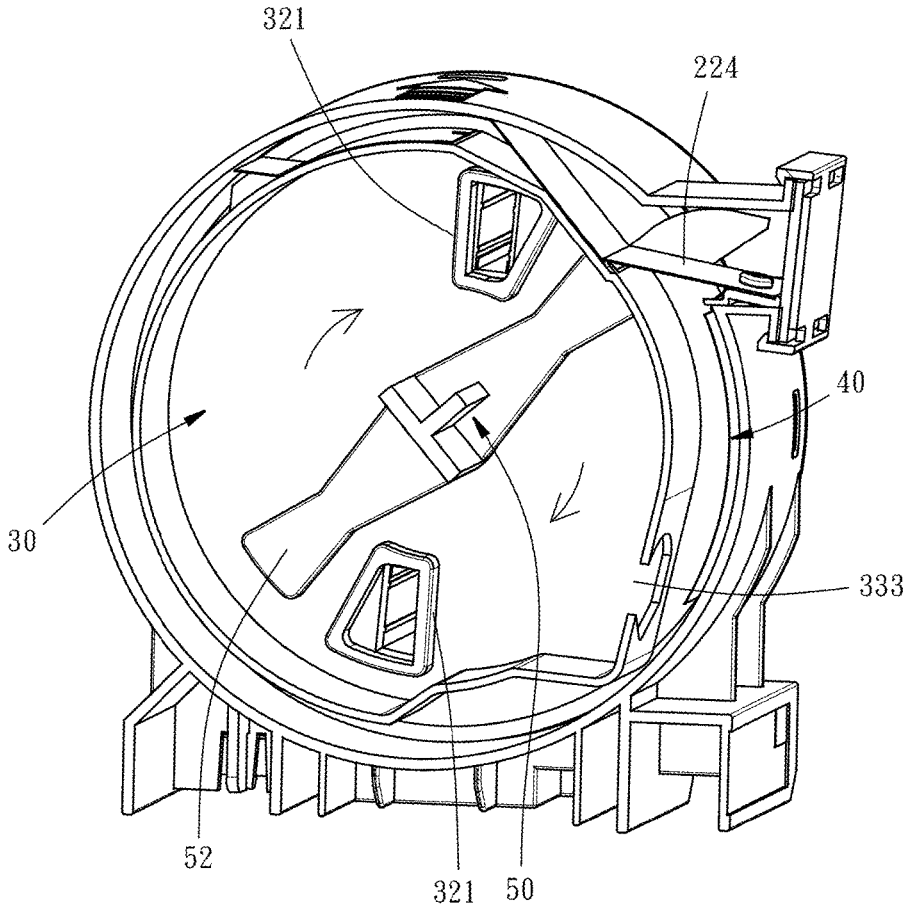
FIG. 12 is a schematic perspective view, showing the transmission cap rotates to a first position.
Figure 13:
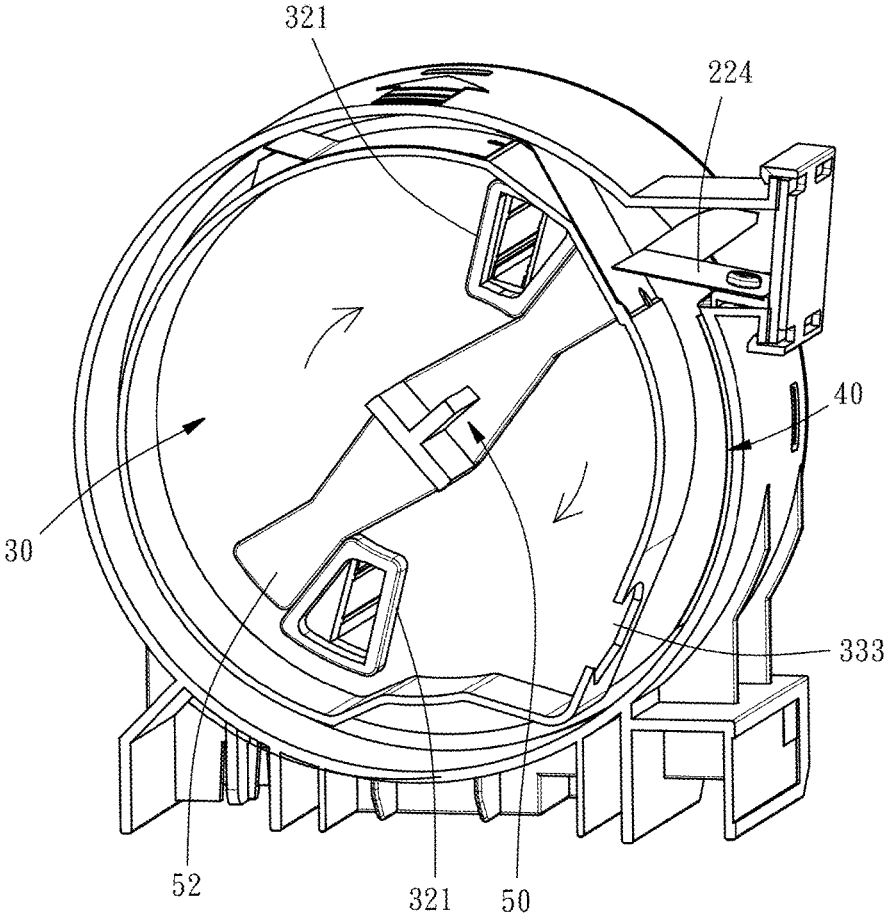
FIG. 13 is a schematic perspective view, showing the transmission cap rotates to a second position.

FIG. 10 shows that the transmission cap 30 stays at an initial position, FIG. 11 shows that the transmission cap 30 rotates to a standby position, and FIGS. 12 and 13 show that the transmission cap 30 rotates to a first position and a second position, respectively. For a new, unused toner cartridge 10 as shown in FIG. 10, the two driven portions 52 of the toner conveying shaft 50 are respectively located at predetermined positions, the two internal drive portions 321 slightly and respectively contact the two driven portions 52 without exerting any driving force to the two driven portions 52, and the first end 42 is adhered over the outlet 333 of the transmission cap 30. When the toner cartridge 10 is installed into an image-forming apparatus, such as a copy machine, the two external drive portions will be driven by a drive of the image-forming apparatus to cause the transmission cap 30 to rotate. When the transmission cap 30 starts to rotate, as shown in FIG. 11, the transmission cap 30 rotates clockwise from the initial position to the standby position. During the aforesaid period of rotation, the outlet 33 of the transmission cap 30 and the first end 42 of the sealing tape 40 adhered over the outlet 333 also rotate clockwise, and the two driven portions 52 still stay stationary at the predetermined positions. During the period that the transmission cap 30 rotates clockwise from the standby position to the first position, the first end 42 of the sealing tape 40, which is stretched by the second end 44, will be peeled off from the outlet 333 of the transmission cap 30, as shown in FIG. 12. Thereafter, the transmission cap 30 continuously rotates to the second position where the two internal drive portions 321 abut against the two driven portions 52, respectively, as shown in FIG. 13. Thereafter, when the transmission cap 30 continuously rotates clockwise from the second position, the two internal drive portions 321 push the two driven portions 52, such that the toner conveying shaft 50 and the transmission cap 30 synchronously rotate about the imaginary center line L relative to the barrel 20. In this way, the toner contained inside the barrel 20 will be moved by the rotary toner conveying shaft 50 toward the opening 21, then discharged to a space between the two protrusion rings 331 via the outlet 333, and thereafter brought by the two resilient pieces 335, which rotate along with the transmission cap 30, to the toner guiding member 224, and finally discharged out of the toner cartridge 10 via the toner exit 221.

With the above-mentioned structural features of the toner cartridge 10 of the present invention, the transmission cap 30 will bring the sealing tape 40, which is adhered over the outlet 333 of the transmission cap 30, to be peeled off first, and thereafter drive the toner conveying shaft 50 to synchronously rotate. Therefore, the problem that the conventional toner cartridge may have, i.e. the problem that the sealing tape may not be peeled off and the toner conveying shaft may not be driven to rotate due to an insufficient torque provided by the rotary transmission cap, can be resolved.

According to the technical features of the present invention, modifications to the structure of the toner cartridge 10 may be available. For example, the second end 44 of the sealing tape 40 may be fixedly mounted to other part of the barrel 20, and the way of mounting the second end 44 is not limited to the one disclosed in this embodiment. Further, the connecting way and corresponding structure between the toner conveying shaft 50 and the transmission cap 30 may be modified as long as the inner lateral side 32 of the transmission cap 30 is provided with at least one inner drive portion 321 and the end of the toner conveying shaft 50 is provided with at least one driven portion 52 to be driven by the at least one drive portion 321. Furthermore, the limit ring 241 provided at the internal periphery 24 of the barrel 20 may be omitted because the design that the protrusion axle 54 of the toner conveying shaft 50 is inserted into the axle coupling portion 323 of the transmission cap 30 may prevent the transmission cap 30 from moving toward an inside of the barrel 20. The structure of the lateral periphery 33 of the transmission cap 30 may be modified as long as the lateral periphery 33 is provided with the outlet for discharging the toner. Any structure helpful for discharging the toner out of the toner cartridge may be modified. For example, the two resilient pieces 335 and/or the toner guiding member 224 may be omitted. The way that the first end 42 of the sealing tape 40 is attached over the outlet 333 of the transmission cap 30 may be modified as long as the first end 42 can be detached from the outlet 3333 after it receives an external force. Moreover, the numbers of the external drive portions 311 and the resilient pieces 335 may vary in accordance with actual need. One or more external drive portions 311 and/or resilient pieces 335 may be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge, comprising:

a barrel having an end with an opening, and a lateral periphery with a toner exit;

a transmission cap rotatably disposed to the end of the barrel and blocking the opening of the barrel, the transmission cap having an outer side provided with at least one outer drive portion, a lateral periphery provided with an outlet, and an inner side provided with at least one inner drive portion;

a sealing tape having a first end that seals the outlet of the transmission cap, and a second end fixedly mounted to the barrel; and a toner conveying shaft rotatably disposed inside the barrel, the toner conveying shaft having an end provided with at least one driven portion;

wherein when the transmission cap rotates from an initial position to a first position, the first end of the sealing tape detaches from the outlet of the transmission cap; when the transmission cap rotates from the first position to a second position, the at least one inner drive portion abuts against the at least one driven portion of the toner conveying shaft; when the transmission cap continuously rotates from the second position, the toner conveying shaft is rotated along with the transmission cap.

2. The toner cartridge as claimed in claim 1, wherein the second end of the sealing tape is disposed to the toner exit of the barrel.

3. The toner cartridge as claimed in claim 1, wherein the toner conveying shaft is rotatably disposed to the transmission cap.

4. The toner cartridge as claimed in claim 3, wherein the toner conveying shaft is provided at the end thereof with a protrusion axle; the transmission cap has an axle coupling portion, through which the protrusion axle of the toner conveying shaft is inserted.

5. The toner cartridge as claimed in claim 1, wherein the transmission cap comprises two said inner drive portions, the toner conveying shaft comprises two said driven portions; when the transmission cap stays at the second position, the two inner drive portions of the transmission cap abut against the two driven portions of the toner conveying shaft, respectively.

6. The toner cartridge as claimed in claim 1, wherein the barrel is provided at an internal periphery thereof with a limit ring for being abutted by an inner lateral edge of the transmission cap.

7. The toner cartridge as claimed in claim 6, wherein the transmission cap is provided at the lateral periphery thereof with two protrusion rings; the outlet of the transmission cap and the toner exit of the barrel are both located between the two protrusion rings.

8. The toner cartridge as claimed in claim 7, wherein the transmission cap is provided at the lateral periphery thereof with at least one resilient piece located between the two protrusion rings; a toner guiding member is disposed to the toner exit of the barrel and extends into a space between the two protrusion rings of the transmission cap.

9. The toner cartridge as claimed in claim 1, wherein the toner conveying shaft comprises at least one conveying blade.

* * * * *